US009679723B2

(12) United States Patent
Campbell et al.

(10) Patent No.: US 9,679,723 B2
(45) Date of Patent: Jun. 13, 2017

(54) VACUUM SWITCHING APPARATUS AND CONTACT ASSEMBLY THEREFOR

(71) Applicant: EATON CORPORATION, Cleveland, OH (US)

(72) Inventors: Louis G. Campbell, Elmira, NY (US); Benjamin A. Rosenkrans, Painted Post, NY (US); Stephen D. Mayo, Horseheads, NY (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 15/148,193

(22) Filed: May 6, 2016

(65) Prior Publication Data

US 2016/0247648 A1 Aug. 25, 2016

Related U.S. Application Data

(62) Division of application No. 14/017,418, filed on Sep. 4, 2013, now Pat. No. 9,378,908.

(51) Int. Cl.

| | |
|---|---|
| ***H01H 33/664*** | (2006.01) |
| ***H01H 1/02*** | (2006.01) |
| ***H01H 33/662*** | (2006.01) |

(52) U.S. Cl.

CPC ..... *H01H 33/664* (2013.01); *H01H 1/0203* (2013.01); *H01H 1/0206* (2013.01); *H01H 33/662* (2013.01); *H01H 33/6643* (2013.01)

(58) Field of Classification Search

CPC .. H01H 1/0203; H01H 1/0206; H01H 33/021; H01H 33/662; H01H 33/664; H01H 33/6643

See application file for complete search history.

(56) References Cited

U.S. PATENT DOCUMENTS

| | | | |
|---|---|---|---|
| 3,764,764 | A | 10/1973 | Takasuna et al. |
| 3,946,179 | A | 3/1976 | Murano et al. |
| 4,495,917 | A | 1/1985 | Byers |
| 4,707,576 | A | 11/1987 | Gessinger et al. |
| 5,120,918 | A | 6/1992 | Thomas et al. |

(Continued)

FOREIGN PATENT DOCUMENTS

| | | | |
|---|---|---|---|
| DE | 4117606 | A1 | 10/1991 |
| GB | 1142209 | A | 2/1969 |

OTHER PUBLICATIONS

European Patent Office, "International Search Report and Written Opinion", Nov. 21, 2014, 9 pp.

*Primary Examiner* — Truc Nguyen

(74) *Attorney, Agent, or Firm* — Eckert Seamans; John Powers; Grant Coffield

(57) ABSTRACT

A contact assembly for a vacuum switching apparatus includes a contact member and a reinforcing member adapted to structurally reinforce the contact member. The contact member includes first and second opposing sides, and a contact thickness. The reinforcing member has a reinforcement thickness, which is less than the contact thickness. The contact member is made from a first material having a first coefficient of thermal expansion, and the reinforcing member is made from a second different material having a second coefficient of thermal expansion. The first coefficient of thermal expansion is substantially the same as the second coefficient of thermal expansion.

11 Claims, 4 Drawing Sheets

(56) References Cited

U.S. PATENT DOCUMENTS

| | | | | |
|---|---|---|---|---|
| 5,852,266 | A * | 12/1998 | Komuro | B22F 3/26 200/279 |
| 6,010,659 | A | 1/2000 | Gentsch et al. | |
| 6,373,358 | B1 | 4/2002 | Davies et al. | |
| 6,437,275 | B1 | 8/2002 | Kikuchi et al. | |
| 2002/0144977 | A1 | 10/2002 | Kikuchi et al. | |
| 2006/0102594 | A1 | 5/2006 | Kikuchi et al. | |
| 2008/0268668 | A1 | 10/2008 | Arai et al. | |
| 2009/0184274 | A1 | 7/2009 | Kikuchi et al. | |
| 2014/0073182 | A1 | 3/2014 | Ardisana, II et al. | |
| 2014/0076852 | A1 | 3/2014 | Kikuchi et al. | |

* cited by examiner

VACUUM SWITCHING APPARATUS AND CONTACT ASSEMBLY THEREFOR

CROSS REFERENCE TO RELATED APPLICATION

This application is a divisional of application Ser. No. 14/017,418, filed on Sep. 4, 2013, and entitled "VACUUM SWITCHING APPARATUS AND CONTACT ASSEMBLY THEREFOR."

BACKGROUND

Field

The disclosed concept relates to vacuum switching apparatus and, in particular, vacuum switching apparatus such as, for example, vacuum interrupters. The disclosed concept also pertains to contact assemblies for vacuum interrupters.

Background Information

Circuit breakers such as, for example, power circuit breakers for systems operating above about 1,000 volts, typically employ vacuum interrupters as the switching devices. Vacuum interrupters generally include separable electrical contacts disposed within an insulating housing. Typically, one of the contacts is fixed relative to both the housing and to an external electrical conductor, which is electrically interconnected with a power circuit associated with the vacuum interrupter. The other contact is part of a movable contact assembly including a stem of circular cross-section and a contact disposed on one end of the stem and enclosed within a vacuum chamber. A driving mechanism is disposed on the other end, external to the vacuum chamber.

The contacts are subjected to significant contact forces, which for example, are associated with relatively high electrical currents. Thus, among other issues, the contacts are susceptible to breaking or bending.

There is, therefore, room for improvement in vacuum switching apparatus, such as vacuum interrupters, and in contact assemblies therefor.

SUMMARY

These needs and others are met by embodiments of the disclosed concept, which are directed to reinforced contact assemblies for vacuum switching apparatus, such as vacuum interrupters.

As one aspect of the disclosed concept, a contact assembly is provided for a vacuum switching apparatus. The contact assembly comprises: a contact member; and a reinforcing member adapted to structurally reinforce the contact member.

The contact member may comprise a first side, a second side disposed opposite the first side, and a contact thickness measured by the distance between the first side and the second side. The reinforcing member may have a reinforcement thickness, wherein the reinforcement thickness is less than the contact thickness. The contact member may further comprise a contact diameter, and the reinforcing member may comprise a reinforcement diameter, wherein the reinforcement diameter is less than the contact diameter.

The reinforcing member may be embedded within the contact member between the first side of the contact member and the second side of the contact member. Alternatively, the reinforcing member may be adhered to a corresponding one of the first side of the contact member and the second side of the contact member.

The contact member may be made from a first material, and the reinforcing member may be made from a second material, wherein the first material is different from the second material. The first material may have a first coefficient of thermal expansion, and the second material may have a second coefficient of thermal expansion. The first coefficient of thermal expansion may be substantially the same as the second coefficient of thermal expansion.

In accordance with another aspect of the disclosed concept, a vacuum switching apparatus comprises: a vacuum envelope; and at least one contact assembly enclosed within the vacuum envelope and comprising: a contact member, and a reinforcing member adapted to structurally reinforce the contact member.

The vacuum switching apparatus may be a vacuum interrupter. The contact assembly may include a fixed contact assembly and a movable contact assembly. The movable contact assembly may be movable between a closed position in electrical contact with the fixed contact assembly and an open position spaced apart from the fixed contact assembly.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
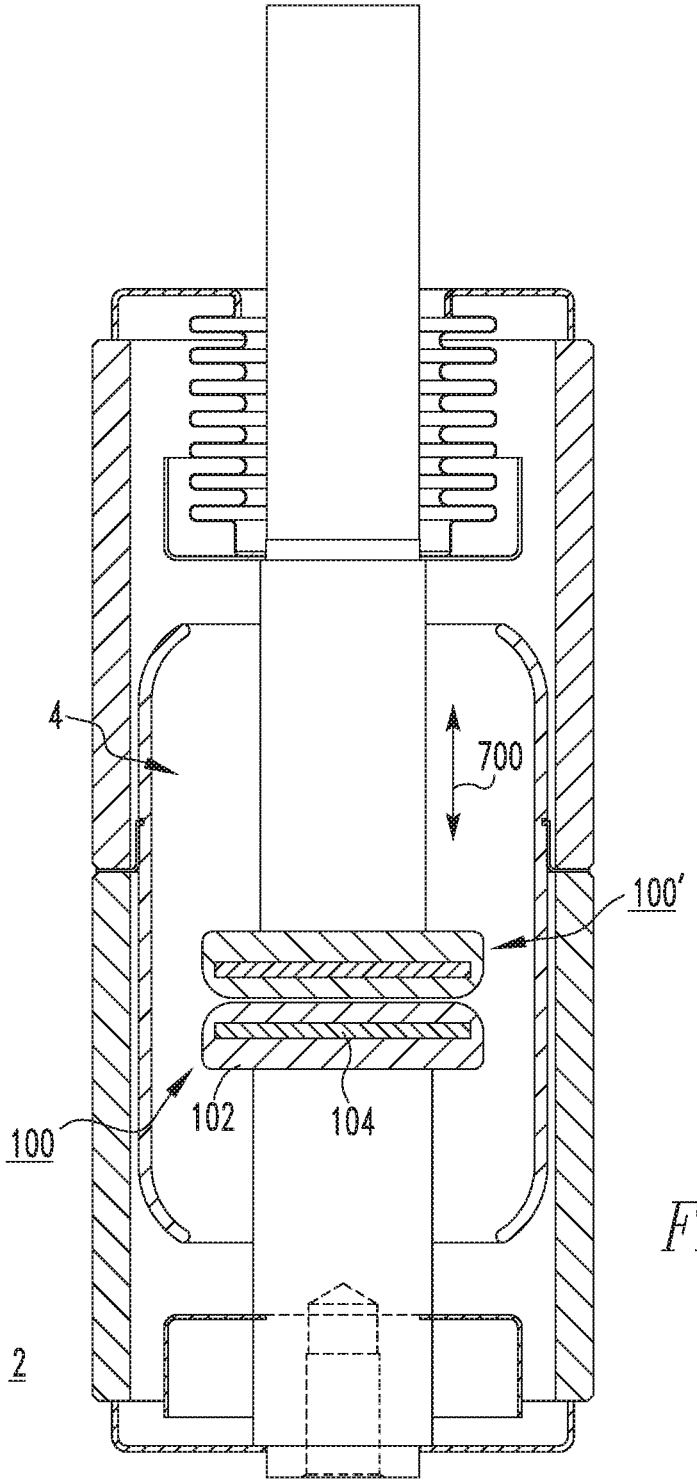
FIG. 1 is a side elevation partially in section view of vacuum interrupter and contact assembly therefor, in accordance with an embodiment of the disclosed concept.

The disclosed concept is described in association with vacuum interrupters, although the disclosed concept is applicable to a wide range of contact assemblies for use with other vacuum switching apparatus and electrical switching apparatus.

Directional phrases used herein, such as, for example, up, down and derivatives thereof, relate to the orientation of the elements shown in the drawings and are not limiting upon the claims unless expressly recited therein.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "adhered" shall mean joined using any known or suitable bonding method (e.g., without limitation, gluing; welding; brazing; soldering; solid state sintering; liquid phase sintering; mechanical pressing; melted material deposit; metallurgical bonding).

As employed herein, the term "embedded" shall mean enclosed within (i.e., encapsulated). For example and without limitation, the reinforcing member of the contact assembly in accordance with the disclosed concept can be embedded within a corresponding contact member using any known or suitable method (e.g., without limitation, induction molding).

As employed herein, the term "vacuum envelope" means an envelope employing a partial vacuum therein.

As employed herein, the term "structurally reinforce" shall mean to intentionally add strength to, or mechanically strengthen, a component such that the structural integrity (e.g., without limitation, bending strength; resistance to bending or breaking) of the component is improved.

As employed herein, the term "number" shall mean one or an integer greater than one (i.e., a plurality).

Referring to FIG. 1, a vacuum switching apparatus, such as a vacuum interrupter 2, is shown. The vacuum interrupter 2 includes a vacuum envelope 4, which is shown in section view in FIG. 1 to show hidden structures. The vacuum interrupter 2 employs contact assemblies 100,100', in accordance with a non-limiting embodiment of the disclosed concept. Specifically, a fixed contact assembly 100 is at least partially within the vacuum envelope 4, and is movable (e.g., without limitation, up and down in the direction of arrow 700, from the perspective of FIG. 1) between the closed position, shown, in electrical contact with the fixed contact assembly 100, and an open position (not shown) spaced apart from the fixed contact assembly 100.

It will be appreciated that, for ease of illustration and economy of disclosure, only the fixed contact assembly 100 will be described, in detail, herein. However, it will be understood that any number of contact assemblies employed by the vacuum switching apparatus 2 may be substantially identical, or alternatively may be of different known or suitable constructions, or a combination thereof.

Figure 2:
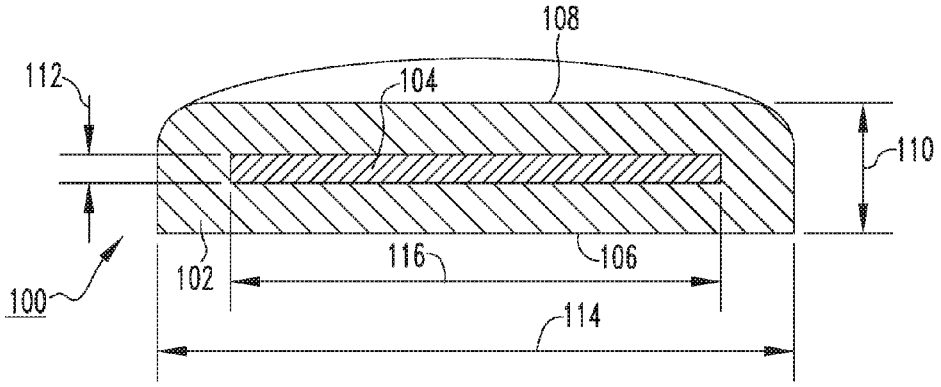
FIG. 2 is an enlarged section view of the contact assembly of FIG. 1.

Continuing to refer to FIG. 1, and also to FIG. 2, each contact assembly 100, in accordance with the disclosed concept, includes a contact member 102, and a reinforcing member 104, which is adapted to structurally reinforce the contact member 102. Thus, among other benefits, the strength or structural integrity of the contact assembly 100, is improved. That is, the contact assembly 100 is substantially less susceptible to bending or breaking in response to relatively high contact forces associated, for example, with relatively high electrical currents. In addition to the foregoing, the disclosed reinforced contact assembly design also permits the overall size (e.g., without limitation, thickness) of the contact assembly 100 to be reduced. This, in turn, can result in cost-savings, for example, because less material is required for the contact assembly.

The contact assembly 100,100',200,300,400,500,600 of the disclosed concept will be further appreciated with reference to the following EXAMPLES, which will now be described with reference to FIG. 1-7. It will be appreciated that the following EXAMPLES are provided solely for purposes of illustration, and are not intended to limit the scope of the disclosed concept.

Example 1

The contact member 102 may include a first side 106, a second side 108 disposed opposite the first side 106, and a contact thickness 110 measured by the distance between the first side 106 and the second side 108, as shown in FIG. 2. The reinforcing member 104 may have a reinforcement thickness 112, which is less than the contact thickness 110. See also contact thickness 310 measured by the distance between first and second sides 306,308 of contact member 302, and reinforcement thickness 312 of reinforcing member 304, in FIG. 4B.

Example 2

The contact member 102 may have a contact diameter 114, and the reinforcing member 104 may have a reinforcement diameter 116. The reinforcement diameter 116 may be less than the contact diameter 114, as shown in FIG. 2.

Example 3

The reinforcing member 104,204,604 may be embedded within the contact member 102,202,602, as shown in FIGS. 2, 3A and 3B, and 7, respectively. Specifically, the reinforcing member 104 may be embedded between the first side 106 of the contact member 102 and the second side 108 of the contact member 102, as best shown in the section view of FIG. 2.

Example 4

The reinforcing member 104,204,304,404 of the contact assembly 100,200,300,400 may be a generally planar member.

Example 5

Figure 3A:
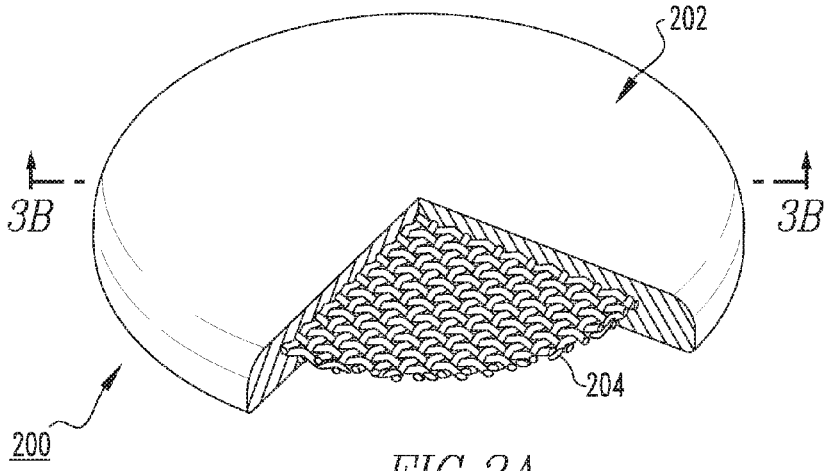
FIG. 3A is an isometric partially in section view of a contact assembly in accordance with another embodiment of the disclosed concept.
Figure 3B:
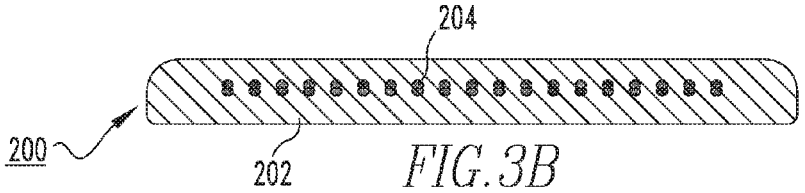
FIG. 3B is a section view taken along line 3B-3B of FIG. 3A.
Figure 5:
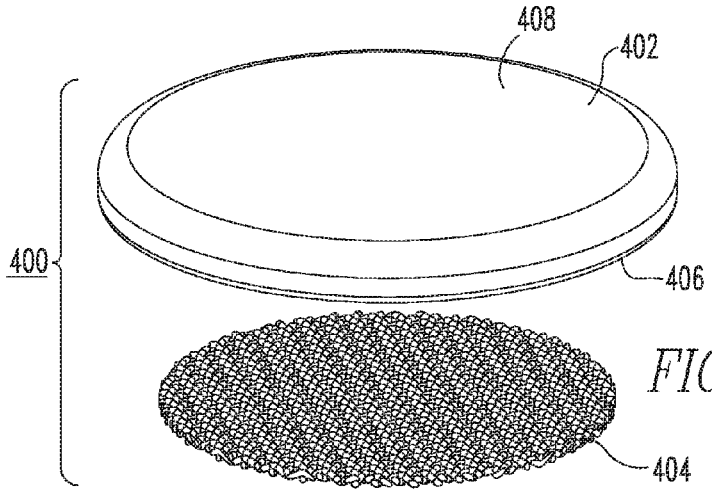
FIG. 5 is an exploded isometric view of a contact assembly in accordance with another embodiment of the disclosed concept.

The reinforcing member 204,404 of the contact assembly 200,400 may be a mesh member, as respectively shown in the non-limiting examples of FIGS. 3A and 3B, and FIG. 5.

Example 6

The reinforcing member (e.g., without limitation, 104, 204,604) can be embedded within the corresponding contact member (e.g., without limitation 102,202,602) using any known or suitable method or process such as, for example and without limitation, vacuum induction casting, insertion into a melt prior to cooling, dipping and removing, or any other known or suitable embedding method or process.

Example 7

Figure 4A:
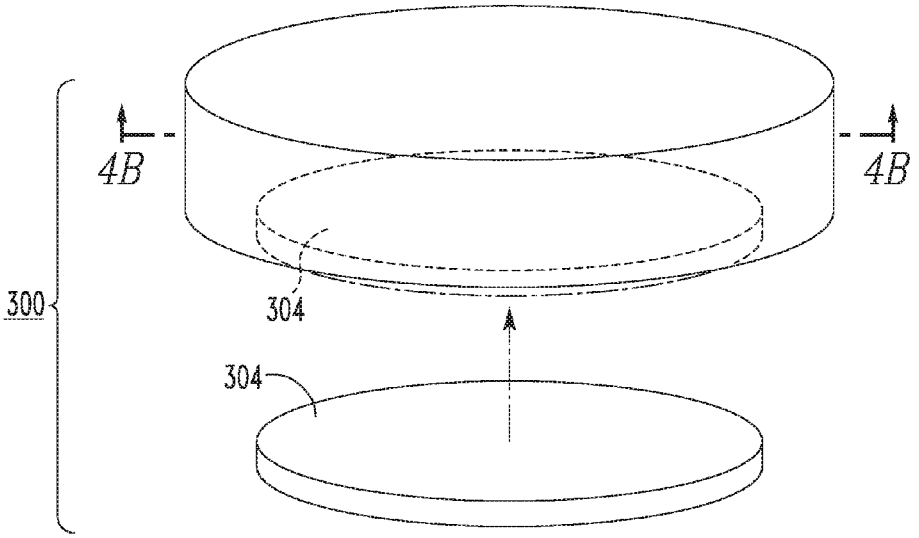
FIG. 4A is an exploded isometric view of a contact assembly in accordance with a further embodiment of the disclosed concept, also showing the contact reinforcement assembled in partially hidden and phantom line drawing.
Figure 4B:
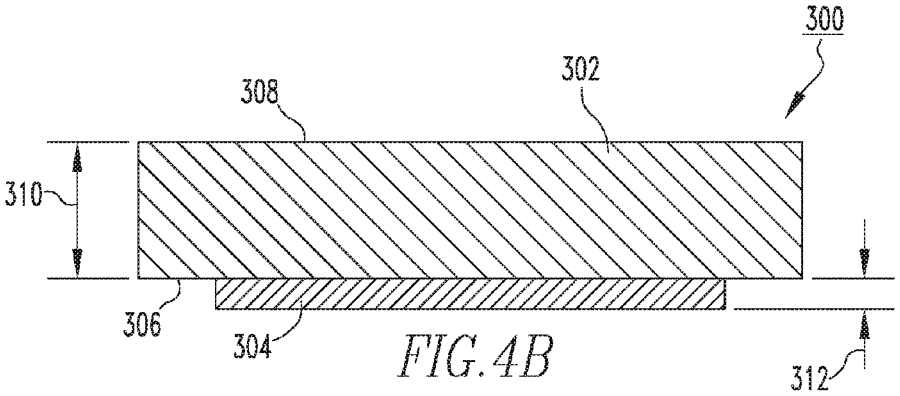
FIG. 4B is a section view taken along line 4B-4B of FIG. 4A.

The reinforcing member 304 may alternatively be suitably adhered to a corresponding one of the first and second sides 306,308 of the contact member 302, as shown in FIGS. 4A and 4B. See also reinforcing member 404 (shown in the exploded orientation prior to being adhered to first side 406 of contact member 402) of FIG. 5, and reinforcing member 504 adhered to contact member 502 of FIG. 6).

Example 8

It will be appreciated that the reinforcing member (e.g. without limitation, 304,404,504) may be adhered to the contact member (e.g., without limitation, 302,402,502)

using any known or suitable adhering method or process such as, for example and without limitation, solid state diffusion sinter bonding, liquid phase sinter bonding, mechanically pressing, welding, brazing, soldering, or otherwise forming a metallurgical bond between the reinforcing member (e.g., without limitation, 304,404,504) and contact member (e.g., without limitation, 302,402,502).

Example 9

Figure 6:
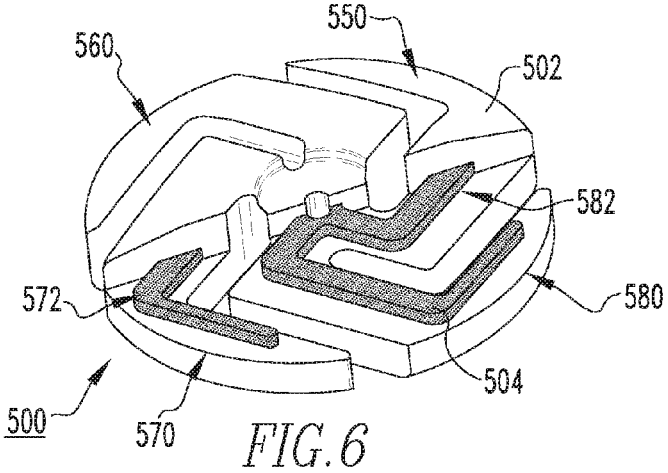
FIG. 6 is an isometric view of a contact assembly in accordance with a further embodiment of the disclosed concept.
Figure 7:
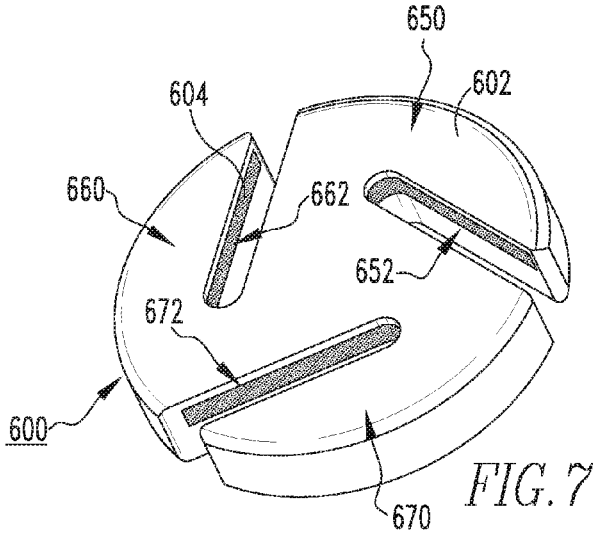
FIG. 7 is an isometric view of a contact assembly in accordance with another embodiment of the disclosed concept.

The contact member 502 of the contact assembly 500 may be a spiral contact having a number of radial segments 550,560,570,580 (four are shown in the non-limiting example of FIG. 6). The reinforcing member 504 may include a number of reinforcing elements 572,582 for the radial segments 570,580 respectively. It will be appreciated that such reinforcing elements (e.g., without limitation, 572,582) may be suitably adhered to or imbedded within the corresponding radial segments (e.g., 570,580) of the spiral contact 502. See also spiral contact 602 of contact assembly 600, wherein the spiral contact 602 includes, for example and without limitation, three radial segments 650,660,670 and the reinforcing member 604 includes three corresponding reinforcing elements 652,662,672. Each reinforcing element 652,662,672 is embedded within the corresponding one of the radial segments 650,660,670, as partially shown in FIG. 7.

Example 10

The contact member 102,202,302,402,502,602 may be made from the first material such as, for example and without limitation, copper. The reinforcing member 104, 204,304,404,504,604 may be made from any known or suitable second material, which is preferably different from the first material of the contact member 102,202,302,402, 502,602. By way of example, and without limitation, the reinforcing member 104,204,304,404,504,604 may be made from tungsten, titanium, carbon-fiber, stainless steel, or any other known or suitable material capable of withstanding elevated temperatures and possessing the necessary material properties to contribute to the strength of the contact assembly 100,200,300,400,500,600.

Example 11

Preferably, the first material has a first coefficient of thermal expansion and the second material has a second coefficient of thermal expansion, which is substantially the same. By matching the thermal coefficients of expansion of the contact member 102,202,302,402,502,602 and the enforcing member 104,204,304,404,504,604, thermally related disadvantages, such as thermal expansion at different rates, and associated issues can be minimized and the integrity of the contact assembly 100,200,300,400,500,600 can be improved.

Accordingly, the disclosed vacuum switching apparatus 2 includes a unique contact assembly 100,200,300,400,500, 600 having a hybrid construction including a contact member 102,202,302,402,502,602 and a reinforcing member 104,204,304,404,504,604, which is suitably embedded or adhered thereto so as to structurally reinforce the contact member 102,202,302,402,502,602. In this manner, among other benefits, the disclosed contact assembly 100,200,300, 400,500,600, resists bending or breaking when subjected to relatively high operating forces, and enables the overall size (see, for example and without limitation, contact thickness 110 and reinforcement thickness 112 of FIG. 2; see also contact thickness 310 and reinforcement thickness 312 of contact assembly 300 of FIG. 4B) to be reduced, thereby correspondingly reducing associated manufacturing and product costs.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A contact assembly for a vacuum switching apparatus, said contact assembly comprising:

a contact member having a planar exterior side and a contact diameter; and a planar reinforcing member having a reinforcement diameter which is less than said contact diameter, said planar reinforcing member being adapted to structurally reinforce said contact member, wherein said planar reinforcing member is disposed on the planar exterior side;

wherein the planar exterior side is a first side; wherein said contact member further comprises a second side disposed opposite the first side, and a contact thickness measured by the distance between the first side and the second side; wherein said reinforcing member has a reinforcement thickness; wherein the reinforcement thickness is less than the contact thickness; and wherein said reinforcing member is a mesh member.

2. The contact assembly of claim 1 wherein said reinforcing member is adhered to the first side of said contact member.

3. The contact assembly of claim 1 wherein said contact member is made from a first material; wherein said reinforcing member is made from a second material; and wherein the first material is different from the second material.

4. The contact assembly of claim 3 wherein the first material has a first coefficient of thermal expansion; wherein the second material has a second coefficient of thermal expansion; and wherein the first coefficient of thermal expansion is substantially the same as the second coefficient of thermal expansion.

5. A contact assembly for a vacuum switching apparatus, said contact assembly comprising:

a contact member having a planar exterior side and a contact diameter; and a planar reinforcing member having a reinforcement diameter which is less than said contact diameter, said planar reinforcing member being adapted to structurally reinforce said contact member, wherein said planar reinforcing member is disposed on the planar exterior side;

wherein the planar exterior side is a first side; wherein said contact member further comprises a second side disposed opposite the first side, and a contact thickness measured by the distance between the first side and the second side; wherein said reinforcing member has a reinforcement thickness; wherein the reinforcement thickness is less than the contact thickness; wherein said contact member is a spiral contact; wherein said spiral contact includes a number of radial segments;

and wherein said reinforcing member includes a number of reinforcing elements for said radial segments.

6. A vacuum switching apparatus comprising:

a vacuum envelope; and at least one contact assembly enclosed within said vacuum envelope and comprising:

a contact member having a planar exterior side and a contact diameter, and a planar reinforcing member having a reinforcement diameter which is less than said contact diameter, said planar reinforcing member being adapted to structurally reinforce said contact member, wherein said planar reinforcing member is disposed on the planar exterior side;

wherein the planar exterior side is a first side; wherein said contact member further comprises a second side disposed opposite the first side, and a contact thickness measured by the distance between the first side and the second side; wherein said reinforcing member has a reinforcement thickness; wherein the reinforcement thickness is less than the contact thickness; and wherein said reinforcing member is a mesh member.

7. The vacuum switching apparatus of claim 6 wherein said reinforcing member is adhered to the first side of said contact member.

8. A vacuum switching apparatus comprising:

a vacuum envelope; and at least one contact assembly enclosed within said vacuum envelope and comprising:

a contact member having a planar exterior side and a contact diameter, and a planar reinforcing member having a reinforcement diameter which is less than said contact diameter, said planar reinforcing member being adapted to structurally reinforce said contact member, wherein said planar reinforcing member is disposed on the planar exterior side;

wherein the planar exterior side is a first side; wherein said contact member further comprises a second side disposed opposite the first side, and a contact thickness measured by the distance between the first side and the second side; wherein said reinforcing member has a reinforcement thickness; wherein the reinforcement thickness is less than the contact thickness; wherein said contact member is a spiral contact; wherein said spiral contact includes a number of radial segments; and wherein said reinforcing member includes a number of reinforcing elements for said radial segments.

9. The vacuum switching apparatus of claim 6 wherein said contact member is made from a first material; wherein said reinforcing member is made from a second material; and wherein the first material is different from the second material.

10. The vacuum switching apparatus of claim 9 wherein the first material has a first coefficient of thermal expansion; wherein the second material has a second coefficient of thermal expansion; and wherein the first coefficient of thermal expansion is substantially the same as the second coefficient of thermal expansion.

11. The vacuum switching apparatus of claim 6 wherein said vacuum switching apparatus is a vacuum interrupter; wherein said at least one contact assembly is a fixed contact assembly and a movable contact assembly; and wherein said movable contact assembly is movable between a closed position in electrical contact with the fixed contact assembly and an open position spaced apart from the fixed contact assembly.

* * * * *